US008498556B2

(12) United States Patent
Kubo

(10) Patent No.: US 8,498,556 B2
(45) Date of Patent: Jul. 30, 2013

(54) DEVELOPING DEVICE AND IMAGE FORMING APPARATUS

(75) Inventor: Keisuke Kubo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 251 days.

(21) Appl. No.: 13/115,721

(22) Filed: May 25, 2011

(65) Prior Publication Data

US 2012/0114382 A1 May 10, 2012

(30) Foreign Application Priority Data

Nov. 9, 2010 (JP) ..... 2010-251020

(51) Int. Cl.
*G03G 15/01* (2006.01)

(52) U.S. Cl.
USPC ..... 399/227; 399/53; 399/119

(58) Field of Classification Search
USPC ..... 399/53, 116, 117, 119, 222–227
See application file for complete search history.

(56) References Cited

U.S. PATENT DOCUMENTS

2006/0039720 A1* 2/2006 Miyazawa et al. ..... 399/227
2008/0286011 A1* 11/2008 Aoki et al. ..... 399/227
2010/0054803 A1* 3/2010 Kawaguchi et al. ..... 399/119

FOREIGN PATENT DOCUMENTS

JP 1-96668 A 4/1989
JP 2000-231238 A 8/2000

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

A developing device includes developing units each including a first gear and a development roller; a rotation supporting member; a cam member having a cam surface surrounding the rotation axis, and being secured to and rotating together with the rotation supporting member; and a driving force transmission member including a cam receiving roller and a second gear. The cam surface includes a curved surface whose curvature is less than a curvature of the cam receiving roller so that, as the first gear approaches a driving position where the first gear receives the driving force from the second gear by the rotation of the cam member, the cam receiving roller is moved away from the rotation axis once, after which the cam receiving roller is moved towards the rotation axis, thereby starting engagement of the first gear with the second gear before the first gear reaches the driving position.

8 Claims, 10 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2010-251020 filed Nov. 9, 2010.

BACKGROUND (i) Technical Field

The present invention relates to a developing device and an image forming apparatus.

(ii) Related Art

Hitherto, a rotary developing device in which developing units are supported around a rotation axis and an image forming apparatus using the rotary developing device are known.

SUMMARY

According to an aspect of the invention, there is provided a developing device including developing units each including a first gear that receives driving force and a development roller that rotates by the driving force received by the first gear; a rotation supporting member that is supported by a base so as to be rotatable around a rotation axis, the rotation supporting member supporting the developing units around the rotation axis, the rotation of the rotation supporting member causing the developing units to revolve around the rotation axis; a cam member having a cam surface surrounding the rotation axis, the cam member being secured to the rotation supporting member and rotating together with the rotation supporting member; and a driving force transmission member including a cam receiving roller and a second gear, the cam receiving roller being biased towards the cam surface while being supported by the base so as to be changeable between to contact and separate from the cam surface, the biasing pushing the cam receiving roller against the cam surface, the second gear being biased along with the cam receiving roller, the second gear engaging the first gear of the developing unit among the developing units whose development roller is moved to a position opposing an image carrying member by the rotation of the rotation supporting member, and transmitting the driving force to the first gear to develop a latent image on the image carrying member. The cam surface includes a curved surface whose curvature is less than a curvature of the cam receiving roller so that, as the first gear approaches a driving position where the first gear receives the driving force from the second gear by the rotation of the cam member, the cam receiving roller is moved away from the rotation axis once, after which the cam receiving roller is moved towards the rotation axis, thereby starting the engagement of the first gear with the second gear before the first gear reaches the driving position.

BRIEF DESCRIPTION OF THE DRAWINGS

Exemplary embodiments of the present invention will be described in detail based on the following figures, wherein.

DETAILED DESCRIPTION

Exemplary embodiments of the present invention will hereunder be described.

Figure 1:
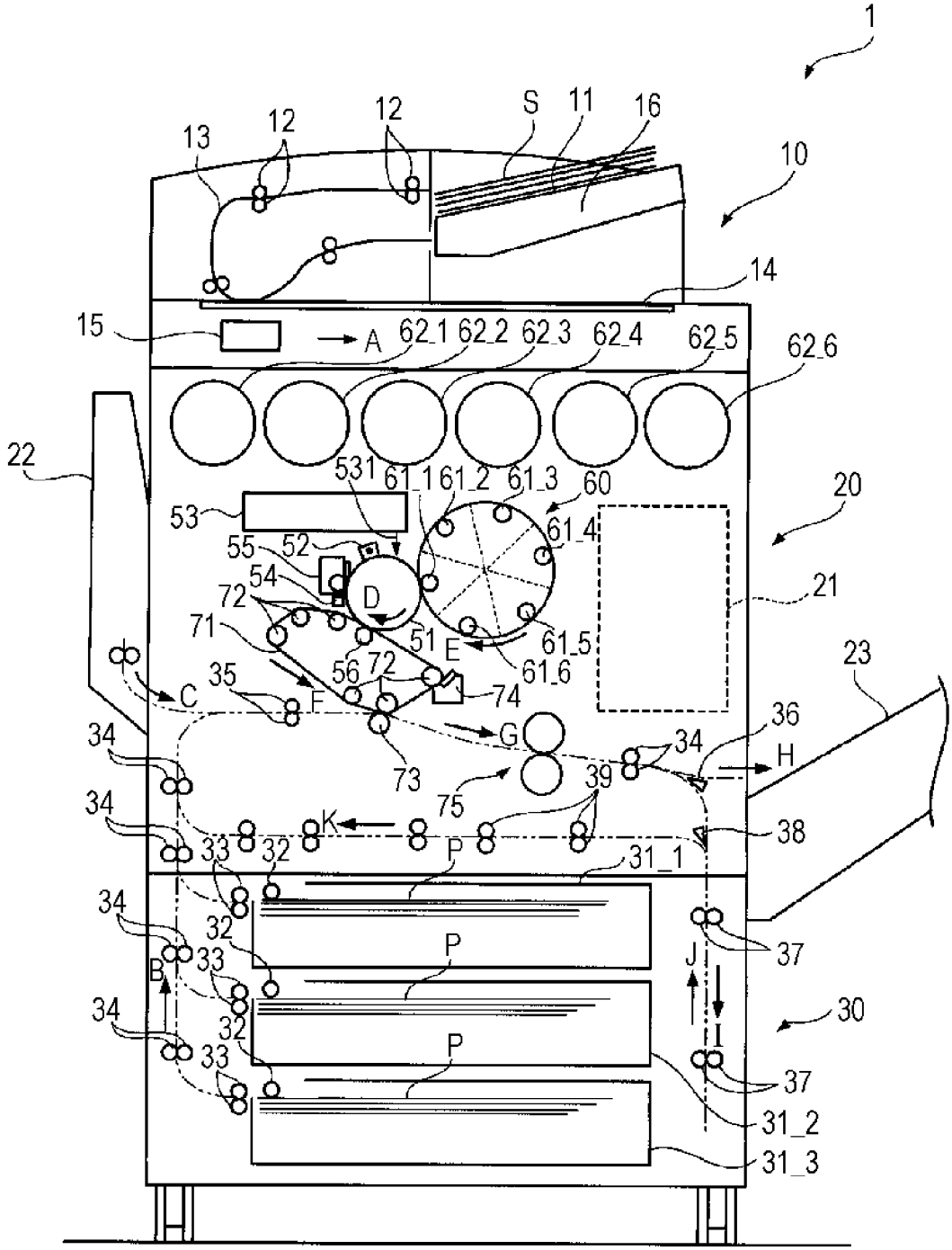
FIG. 1 is a schematic view of the structure of an image forming apparatus according to an exemplary embodiment of the present invention.

FIG. 1 is a schematic view of the structure of an image forming apparatus 1 according to an exemplary embodiment of the present invention. A developing device 60 is installed in the image forming apparatus 1 shown in FIG. 1. The developing device 60 corresponds to a developing device according to an exemplary embodiment of the present invention.

The image forming apparatus 1 includes an original reading unit 10, an image forming unit 20, and a sheet holding unit 30.

The original reading unit 10 is provided with an original supplying table 11 on which originals S are placed upon each other. The originals S that are placed on the original supplying table 11 are sent out one at a time, and are transported along a transport path 13 by transporting rollers 12. Then, characters and images recorded on the transported originals are read by an original reading optical system 15, after which the originals are discharged onto an original discharging table 16. The original reading optical system 15 is disposed below an original reading plate 14 formed of transparent glass.

The original reading unit 10 has a hinge extending leftwards and rightwards at an inner side of the original reading unit 10. With the hinge as a rotation center, it is possible to lift up the original supplying table 11 and the original discharging table 16 together. The original reading plate 14 extends below the lifted original supplying table 11 and original discharging table 16. In the original reading unit 10, it is possible to place only one original facing downward on the original reading plate 14 instead of placing the originals on the original supplying table 11, and move the original reading optical system 15 in the direction of arrow A to read the characters and images from the original placed on the original reading plate 14.

An image signal obtained at the original reading optical system 15 is input to a processing/control circuit 21. The processing/control circuit 21 forms an image on the basis of the input image signal as follows. The processing/control circuit 21 controls the operation of each portion of the image forming apparatus 1.

Three sheet feeding tables 31_1, 31_2, and 31_3 are installed in the sheet holding unit 30 provided at a lower portion of the image forming apparatus 1. The sheet feeding tables 31_1, 31_2, and 31_3 hold sheets of paper P that are placed upon each other and that, for example, have different sizes in accordance with the sheet feeding tables 31_1, 31_2, and 31_3. The sheet feeding tables 31_1, 31_2, and 31_3 are formed so that they are capable of being drawn out for replenishing them with sheets of paper P.

Among the three sheet feeding tables 31_1, 31_2, and 31_3, for example, the sheet feeding table holding the sheets of paper P having a size that is in accordance with the size of the originals (here, the sheet feeding table 31_3) are sent out by a pickup roller 32. Then, the sheets of paper P are separated one by one by picking rollers 33, to transport one sheet of paper P at a time upward in the direction of arrow B by transporting rollers 34. Then, standby rollers 35 adjust a subsequent transportation timing, so as to further transport each sheet of paper P. Transportation of each sheet of paper P subsequent to the transportation by the standby rollers 35 will be described below.

The image forming unit 20 is provided with a manual sheet feeding table 22. The manual sheet feeding table 22 is a folding type that opens with its lower end as center.

It is possible to open the manual sheet feeding table 22, place sheets thereon, and send out the sheets placed on the manual sheet feeding table 22 in the direction of arrow C.

A photoconductor member 51 that rotates in the direction of arrow D is provided at a central portion of the image forming unit 20. A charging unit 52, the developing device 60, an electricity removing unit 54, and a cleaner 55 are disposed around the photoconductor member 51. An exposure unit 53 is disposed above the photoconductor member 51. A transfer unit 56 is disposed at a position where the transfer unit 56 and the photoconductor member 51 nip an intermediate transfer belt 71 (described later).

The photoconductor member 51 has a cylindrical shape. By charging the photoconductor member 51, electric charge is stored. By exposing the photoconductor member 51, the electric charge is released, so that an electrostatic latent image is formed on the surface of the photoconductor member 51.

The charging unit 52 charges the surface of the photoconductor member 51 to a certain charging potential.

The image signal from the processing/control circuit 21 is input to the exposure unit 53, and a light beam 531 that is modulated in accordance with the input image signal is output. The light beam 531 repeatedly scans in a direction of a rotation axis of the photoconductor member 51 (that is, a direction perpendicular to the plane of the sheet of FIG. 1) a portion of a surface 51 of the photoconductor member 51 that is charged by the charging unit 52. The photoconductor member 51 rotates in the direction of arrow D. The scanning causes the electrostatic latent image to be formed on the surface of the photoconductor member 51.

After forming the electrostatic latent image on the surface of the photoconductor member 51 as a result of scanning the photoconductor member 51 with the optical beam 531, the electrostatic latent image is developed by the developing device 60, so that a toner image is formed on the surface of the photoconductor member 51. Here, the developing device 60 includes six developing units 61_1, 61_2, 61_3, 61_4, 61_5, and 61_6. The developing device 60 rotates in the direction of arrow E, so that one of the six developing units 61_1 to 61_6 (that is, the developing unit 61_1 in the state shown in FIG. 1) is moved to a position that opposes the photoconductor member 51. The electrostatic latent image that is formed on the photoconductor member 51 is developed by the developing unit (here, the developing unit 61_1) that opposes the photoconductor member 51, to form the toner image.

The six developing units 61_1 to 61_6 of the developing device 60 contain yellow (Y) toner, magenta (M) toner, cyan (C) toner, and black (K) toner, toner of one special color, and tone of another special color, respectively. The toners of the two special colors are in accordance with the purpose of use of a user. In developing the electrostatic latent image on the photoconductor member 51, the developing unit containing the toner of the color that is used this time is rotated to a position opposing the photoconductor member 51. The developing unit that opposes the photoconductor member 51 develops the electrostatic latent image using the color toner contained in this developing unit. Examples of the toners of the two special color that are in accordance with the purpose of use of the user are transparent toner used in image rusting and toner whose color is adjusted to that frequently used by the user.

Six toner tanks 62_1 to 62_6 are placed above the developing device 60, and contain toners whose colors are the same as those of the color toners used in the six developing units 61_1 to 61_6, respectively. When the toner amounts in the respective developing units 61_1 to 61_6 are reduced, the toners are supplied into the respective developing units 61_1 to 61_6 from the toner tanks 62_1 to 62_6 containing the toners of the corresponding colors.

The toner image that is formed on the photoconductor member 51 by developing the electrostatic latent image by the developing unit is transferred to the intermediate transfer belt 71 by the action of the transfer unit 56.

The electricity of the photoconductor member 51 is removed by the electricity removing unit 54 after the transfer. Then, any toner remaining on the photoconductor member 51 after the transfer is removed by the cleaner 55.

The intermediate transfer belt 71 is an endless belt that is placed around rollers 72 and that circulates in the direction of arrow F. A transfer unit 73 is disposed near the intermediate transfer belt 71 where a transfer path of sheets of paper P is interposed between the transfer unit 73 and the corresponding roller 72. A cleaner 74 is disposed downstream from the transfer unit 73 in the direction of circulation of the intermediate transfer belt 71. The cleaner 74 removes any toner remaining on the intermediate transfer belt 71 after transferring the image by the transfer unit 73. The transfer unit 73 and the cleaner 74 are spaced from the intermediate transfer belt 71 so that they are capable of contacting the intermediate transfer belt 71. When an image of multiple colors is to be formed, a process in which the transfer unit 73 and the cleaner 74 are spaced from the intermediate transfer belt 71 and in which a toner image of one color is formed on the photoconductor member 51 and transferred to the intermediate transfer belt 71 is repeated for the multiple developing units (corresponding to the toners of multiple colors) while rotating the developing device 60. Accordingly, the multiple toner images (formed using the toners of the multiple colors) are successively placed upon and transferred to the intermediate transfer belt 71.

Thereafter, the transfer unit 73 is caused to contact the intermediate transfer belt 71. When the toner images of the multiple colors that are placed upon each other reach a transfer position where the transfer unit 73 is disposed, a sheet of paper P is sent out by the standby rollers 35 so as to also reach the transfer position. At the transfer position, the action of the transfer unit 73 causes the toner images of the multiple colors on the intermediate transfer belt 71 to be transferred to the sheet of paper P. The sheet of paper P to which the toner images are transferred is further transported in the direction of arrow G, and is subjected to heat and pressure by a fixing unit 75, so that fixed toner images are formed on the sheet of paper. The sheet of paper that has passed through the fixing unit 75 is further transported in the direction of arrow H, and is discharged onto a sheet discharging table 23.

The cleaner 74 is moved so as to also contact the intermediate transfer belt 71. Any toner remaining on the intermediate transfer belt 71 after transferring the toner images by the transfer unit 73 is removed by the cleaner 74, from the intermediate transfer belt 71.

The image forming apparatus 1 is capable of forming images on both surfaces of a sheet of paper P. When forming images on both surfaces of a sheet of paper P, the sheet of paper P on which an image is formed on only a first surface of the sheet of paper P as described above is not discharged onto the sheet discharging table 23. Rather, by a switching operation by a guiding member 36, the sheet of paper P is transported in the direction of arrow I by transporting rollers 37. Then, after reversing the direction of transportation, by a switching operation of the other guiding member 38, the sheet of paper P is transported by transporting rollers 39 in the direction of arrow K, and reaches the standby rollers 35.

Thereafter, an image is formed on a second surface of the sheet of paper P by similarly performing the above-described operations again. The sheet of paper P having the images formed on both surfaces in this way is next discharged to the sheet discharging table 23.

Figure 2:
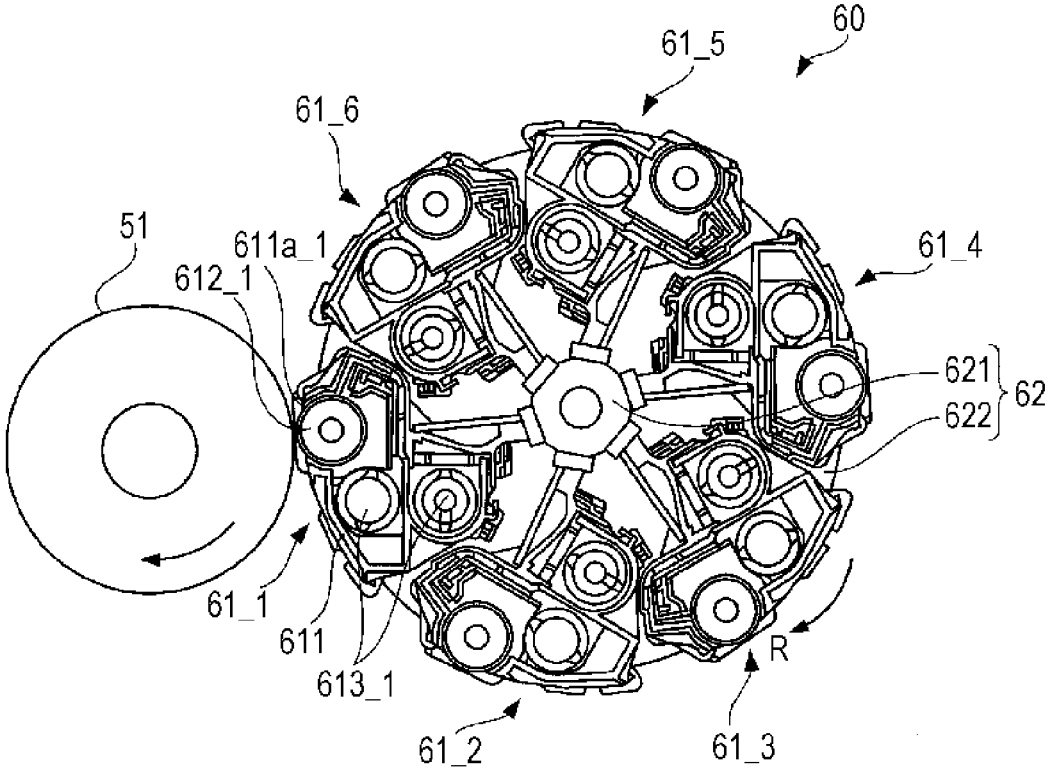
FIG. 2 is a sectional view of a developing device schematically shown in FIG. 1.
Figure 3:
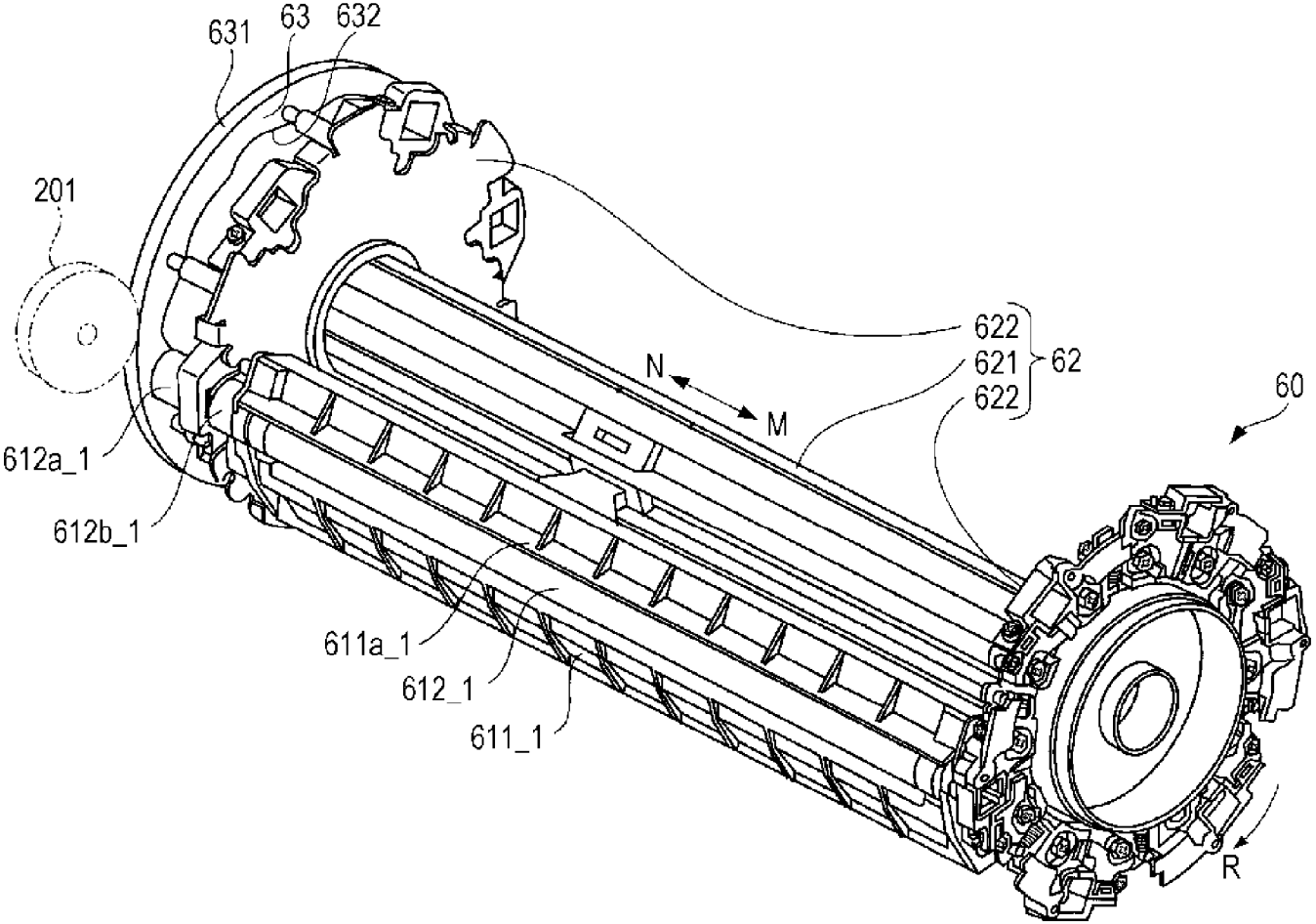
FIG. 3 is a perspective view of the developing device.

FIG. 2 is a sectional view of the developing device schematically shown in FIG. 1. FIG. 3 is a perspective view of the developing device. However, FIG. 3 shows a state in which only one of the six developing units (that is, the developing unit 61_1) is supported, whereas the other developing units 61_2 to 61_6 are removed.

The developing device 60 includes a rotation supporting member 62. The rotation supporting member 62 includes a rotation shaft member 621 and supporting members 622. The rotation shaft member 621 extends in the direction of a rotation axis thereof (that is, in a direction perpendicular to the sheet plane of each of FIGS. 1 and 2, or in a direction of arrow M-N shown in FIG. 3). The rotation shaft member 621 is rotatably supported by an apparatus body of the image forming apparatus 10 shown in FIG. 1. The supporting members 622 are provided on respective ends of the rotation shaft member 621 in the direction of the rotation axis thereof, project outward of the rotational shaft member 621 in a radial direction thereof in the form of flanges, and support the six developing units 61_1 to 61_6. Here, a side in the direction of arrow M shown in FIG. 3 is the front side of the image forming apparatus (see FIG. 1), and a side in the direction of arrow N shown in FIG. 3 is the rear side of the image forming apparatus (see FIG. 1). The six developing units 61_1 to 61_6 are disposed in a space between the two supporting members 622 along one circumference of the rotation shaft member 621 with the angular positions of the developing units being varied 60 degrees at a time. The six developing units 61_1 to 61_6 are supported by these two supporting members 622.

Here, the developing units 61_1 to 61_6 have the same structural features except that their positions and orientations are varied 60 degrees at a time. The developing unit 61_1, which is described as a typical example, includes a case 611_1, a development roller 612_1, and two augers 613_1. The case 611_1 has an opening **611*a*_1 that exposes the development roller 612_1. A developer including toner whose color differs in accordance with each developing unit is contained in the case 611_1. The development roller 612_1 rotates as a result of a gear 612*a*_1 receiving rotational driving force. By this rotation, the developer is adhered to the surface of the development roller 612_1, and is brought to a position opposing the photoconductor member 51, so that the electrostatic latent image on the photoconductor member 51 is developed using the toner. The two augers 613_1 rotate as a result of receiving rotational driving force from the other gear 612*b*_1 secured to the development roller 612_1, so that the developer in the case 611_1 is circulated and transported in the direction of the rotation axis while. being mixed in the case 611_1**.

The developing device 60 includes an annular member 63 having a gear train 631 (not shown) formed at an outer peripheral surface at the rear side of the annular member 63 and having a cam surface 632 formed at an inner peripheral surface at the rear side of the annular member 63. Driving force is transmitted to the gear train 631 at the outer peripheral surface of the annular member 63 from a gear 201 at the body of the image forming apparatus that transmits driving force of a motor (not shown) provided at the body of the image forming apparatus. The driving force causes the rotation supporting member 62 to rotate 60 degrees at a time in the direction of arrow R, so that the six developing units 61_1 to 61_6 supported by the supporting members 622 revolve around the rotation shaft member 621. When the developing units 61_1 to 61_6 revolve 60 degrees at a time, the developing unit that is used for a developing operation this time is moved to a position where it opposes the photoconductor member 51 (that is, the position of the developing unit 61_1 shown in FIG. 2).

Figure 4:
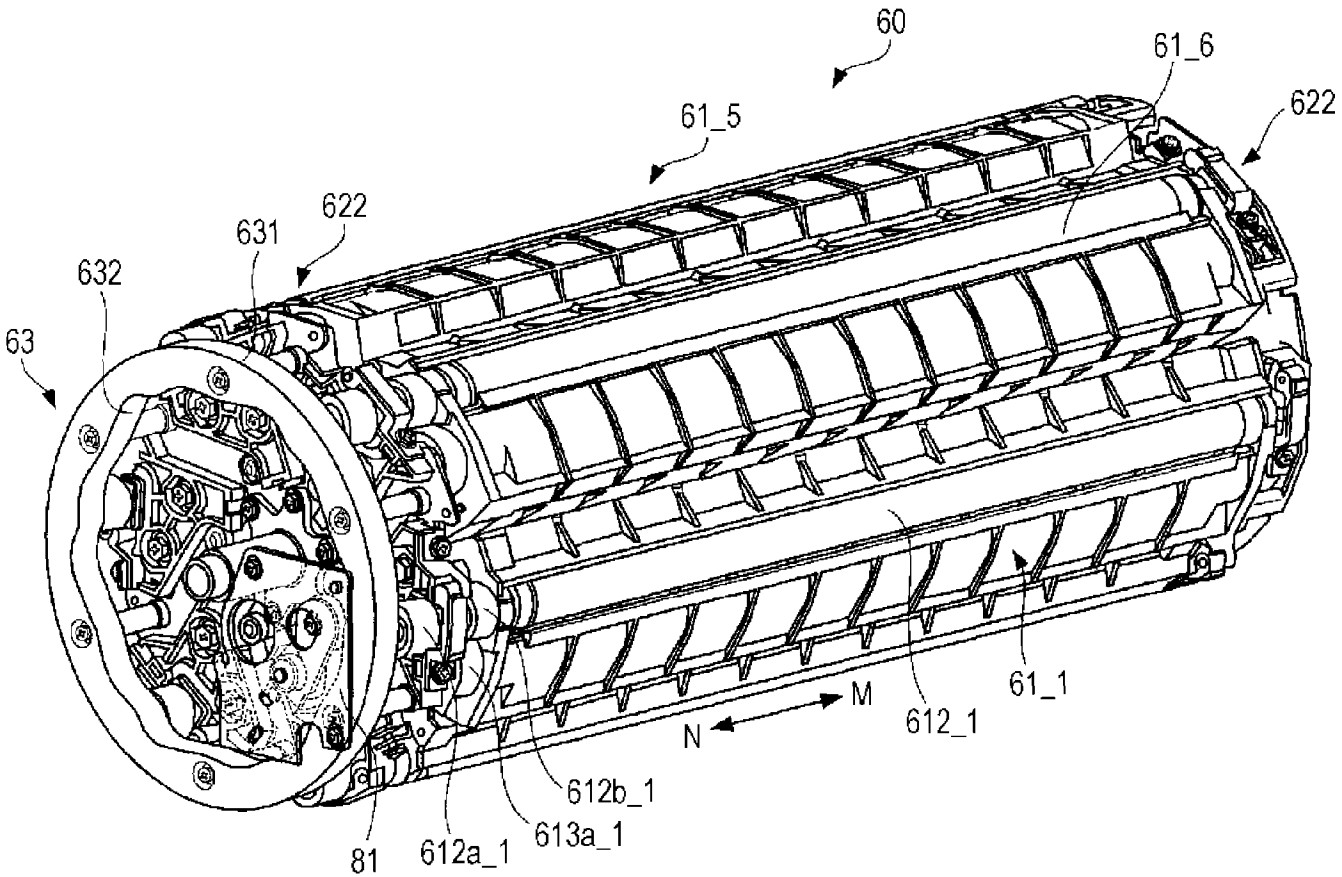
FIG. 4 is a perspective view of the developing device that is seen obliquely from its rear.

FIG. 4 is a perspective view of the developing device that is seen obliquely from its rear.

FIG. 4 shows some of the developing units including the developing unit 61_1 among the six developing units 61-1 to 61-6 (see FIGS. 1 and 2). The developing unit 61-1 is in a state in which it is moved to a driving position by the body of the image forming apparatus.

FIG. 4 shows the annular member 63 provided at the rear side of the developing device 60 (that is, at a rear end defined by the arrow N). Further, FIG. 4 shows a plate member 81 that is secured to a frame (not shown) of the body of the image forming apparatus.

Still further, FIG. 4 also shows a gear **613*a*_1 at the augers 613_1 (see FIG. 2) that engages the gear 612*b*_1 coaxially provided with the development roller 612_1. When driving force is transmitted to the gear 612*a*_1 and the development roller 612_1 rotates, the gear 612*b*_1 also rotates, so that this rotational driving force is transmitted to the gear 613*a*_1, causing the augers 613_1** to rotate.

Figure 5:
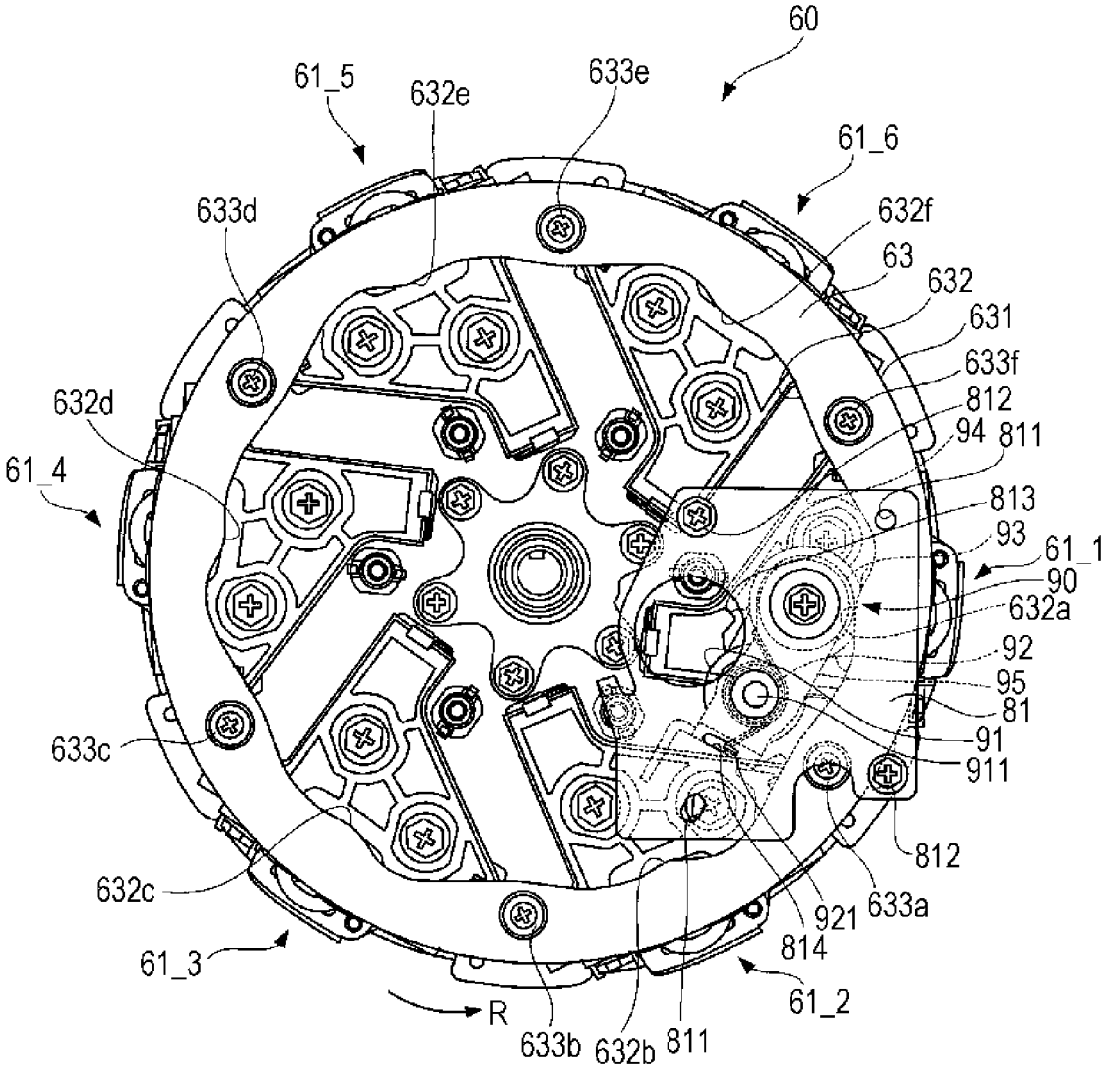
FIG. 5 shows the developing device that is seen from its rear in a direction of a rotation axis.

FIG. 5 shows the developing device that is seen from its rear in the direction of the rotation axis.

The plate member 81 has two positioning holes 811 and two screw stoppage holes 812. The plate member 81 is positioned at the frame of the body of the image forming apparatus, and is secured thereto with two screws.

The plate member 81 has a circular hole 813. A gear (not shown) for transmitting driving force to the developing device 60 from a motor (not shown) at the body of the image forming apparatus is inserted into the hole 813. A driving force transmission mechanism 90 that receives the driving force from the gear (not shown) inserted from the hole 813, and that transmits the driving force to the developing unit (that is, the developing unit 61_1 in a rotation state shown in FIG. 5) is provided at the back of the plate member 81. A gear 91 constituting the driving force transmission mechanism 90 has its rotation shaft 911 rotatably supported by the plate member 81.

The inner peripheral surface of the annular member 63 corresponds to the cam surface 632. A cam receiving roller 93 that is biased by a coil spring 92 is pushed against the cam surface 632. One end 921 of the coil spring 92 is caught by a hole 814 of the plate member 81. The coil spring 92 and the cam receiving roller 93 are parts that constitute the driving force transmission member 90. The driving force transmission member 90 will be described in more detail below.

In the state shown in FIG. 5, the cam receiving roller 93 is in contact with a contact position 632*a* of the cam surface 632. In the state in which the cam receiving roller 93 contacts the contact position 632*a*, the gear 612*a*_1 constituting the developing unit 61_1 is at the driving position where it receives the driving force through the driving power transmission mechanism 90. That is, at the driving position, the gear 612*a*_1 of the developing unit 61_1 engages the other gear 94 constituting the driving force transmission mechanism 90, so that the driving force is transmitted to the gear 612*a*_1.

As mentioned above, the developing device 60 rotates 60 degrees at a time in the direction of arrow R. Here, the direction of arrow R shown in FIG. 5 appears to be in a direction that is opposite to the direction of arrow R in FIGS. 2 and 3. This is because FIG. 5 is viewed from the rear. Accordingly, the directions of rotation of the developing device 60 are the same.

When the developing device 60 is rotated by 60 degrees in the direction of arrow R, a gear of the next developing unit 61_2 (that is, a gear corresponding to the gear 612*a*_1 of the developing unit 61_1) reaches the driving position, so that the cam receiving roller 93 contacts a contact position 632*b* that is in correspondence with the developing unit 61_2. In this state, the developing unit 61_2 is driven. Similarly, when the developing device 60 rotates 60 degrees at a time, gears of the respective developing units 61_3 to 61_6 successively reach the driving position, so that the cam receiving roller 93 contacts successively contact positions 632*c* to 632*f*, respectively. In these states, the developing units 61_3 to 61_6 are successively driven.

Screw stoppage portions 633*a* to 633*f* are provided between two adjacent contact positions (such as the contact positions 632*a* and 632*b*) among the contact positions 632*a* to 632*f*. The screw stoppage portions 633*a* to 633*f* are for screwing the annular member 63 to the body of the developing device.

The annular member 63 is a member whose length from the center (screw center) of the screw stoppage portion (such as the screw stoppage portion 633*a*) adjacent to one of the contact positions (such as the contact position 632*a*) to the next contact position (such as the contact position 632*b*) is longer than the length from the one of the contact positions (such as the contact position 632*a*) to the center (screw center) of the screw stoppage portion (such as the screw stoppage portion 633*a*), towards a downstream side in a direction of relative movement of the cam receiving roller 93 as the developing device 60 rotates in the direction of arrow R, that is, with reference to the state shown in FIG. 5. This is to make gentle a curved surface between the screw stoppage portion (such as the screw stoppage portion 633*a*) of the cam surface 632 (formed at the inner peripheral surface of the annular member 63) and the contact position (such as the contact position 632*b*) that is adjacent to the downstream side of this screw stoppage portion (such as the downstream side in the direction of relative movement of the cam receiving roller 93). An action when the curve is made gentle will be described below.

Figure 6:
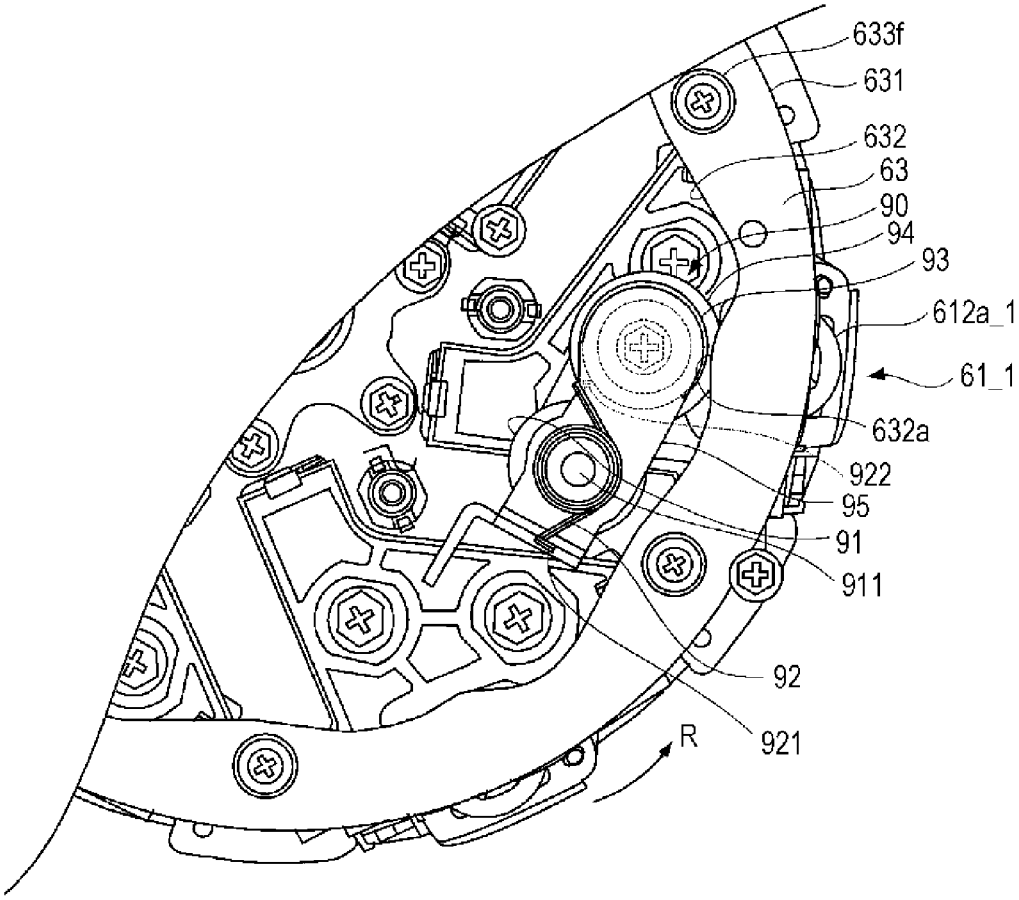
FIG. 6 is a partial view of the developing device that is seen from its rear in the direction of the rotation axis.

FIG. 6 is a partial view of the developing device that is seen from its rear in the direction of the rotation axis. FIG. 6 shows the driving force transmission mechanism 90 without the plate member 81 shown in FIG. 5.

Figure 7:
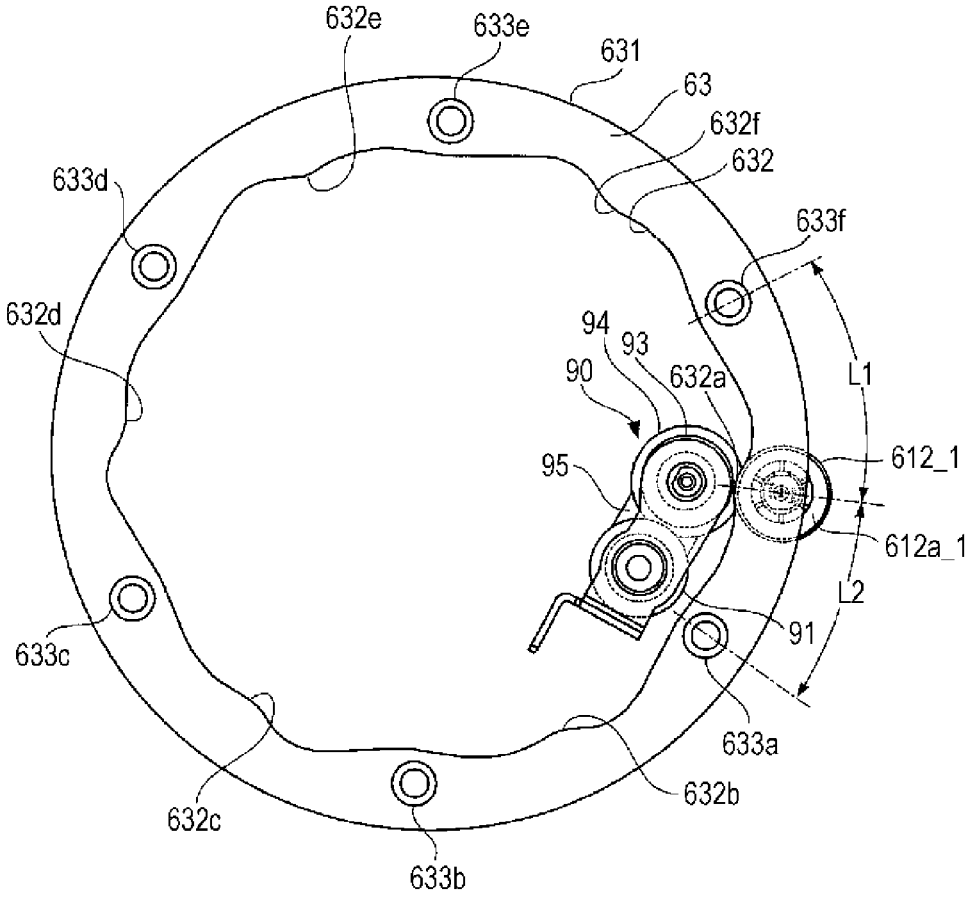
FIG. 7 shows a driving force transmission mechanism for transmitting driving force to a developing unit, the driving force transmission mechanism being seen from its rear in the direction of the rotation axis.
Figure 8:
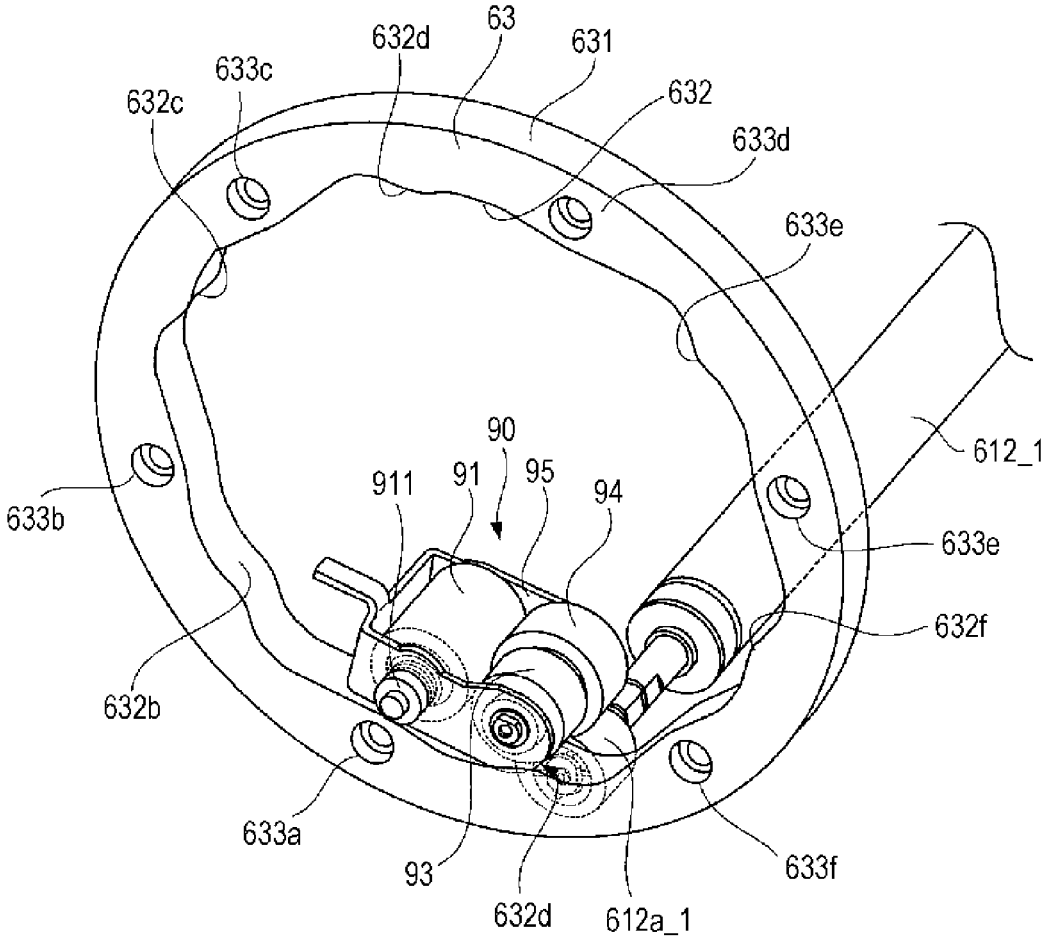
FIG. 8 is a perspective view of the driving force transmission mechanism that is the same as that shown in FIG. 7 and that is seen obliquely from its rear.

FIG. 7 shows the driving force transmission mechanism for transmitting driving force to the developing unit, the driving force transmission mechanism being seen from its rear in the direction of the rotation axis. FIG. 8 is a perspective view of the driving force transmission mechanism that is the same as that shown in FIG. 7 and that is seen obliquely from its rear. However, in FIGS. 7 and 8, the coil spring 92 is not shown.

The driving force transmission mechanism 90 will be described with reference to FIGS. 6 to 8.

The driving force transmission mechanism 90 includes the other gear 94 to which driving force is transmitted from the gear 91, in addition to the cam receiving roller 93 and the gear 91 subjected to the driving force from the gear (not shown) at the body of the image forming apparatus and inserted from the hole 813 (see FIG. 5) of the plate member 81. This gear 94 has the driving force transmitted thereto from the gear 91, so that the gear 612*a*_1 secured to the development roller 612 of the developing unit (here, the developing unit 61_1) is driven, thereby rotating the development roller 612_1. As mentioned above, when the development roller 612_1 is rotated, the other gear 612*b*_1 (see FIG. 4) coaxially secured to the development roller 612_1 is rotated. From the gear 612*b*_1, the driving force is transmitted to the gear 613*a*_1 (see FIG. 4) that rotates the augers 613_1 (see FIG. 2). Therefore, the augers 613_1 also rotate.

As shown in FIG. 8, the driving force transmission mechanism 90 is provided with a case 95. The case 95 is rotatably supported by the rotating shaft 911 of the gear 91. As mentioned above, the rotating shaft 911 is rotatably supported by the plate member 81 that is secured to the frame (shown in FIG. 5) of the body of the image forming apparatus. The cam receiving roller 93 and the gear 94 are coaxially provided, and are rotatably supported by the case 95. The driving force transmission mechanism 90 further includes the coil spring 92 (shown in FIGS. 5 and 6). As shown in FIG. 5, the one end 921 of the coil spring 92 is caught by the plate member 81. As shown in FIG. 6, the other end 922 of the coil spring 92 is caught by the case 95. The entire case 95 including the cam receiving roller 93 and the gear 94 is biased towards the annular member 63. By the biasing, the cam receiving roller 93 is pushed against the cam surface 632 at the inner peripheral surface of the annular member 63. In this way, when the annular member 63 rotates as the developing device 60 rotates, the driving force transmission mechanism 90 rotates along the shape of the cam surface 632 around the rotating shaft 911.

When the rotation of the annular member 63 causes the cam receiving roller 93 to move relatively along the cam surface 632 and to reach the contact position 632*a*, the developing unit 61_1 is at that position. The gear 94 engages the gear 612*a*_1 of the developing unit 61_1. When the driving force is transmitted to the gear 91 from the body of the image forming apparatus, the driving force is transmitted from the gear 91 is transmitted to the developing unit 61_1 through the gear 94. As mentioned above, when the developing device 60 is rotated 60 degrees at a time, the cam receiving roller 93 relatively reaches each of the contact positions 632*b* to 632*f*. The gear 94 engages the gears of the respective developing units 61_2 to 61_6 (corresponding to the gear 612*a* 1 of the developing unit 61_1) that are rotated to the driving position, so that the driving forces are transmitted to the respective developing units 61_2 to 61_6. As mentioned above, the developing units 61_1 to 61_6 to which the driving forces are transmitted are developing units that are rotated to the position opposing the photoconductor member 51 (see FIGS. 1 and 2).

Next, the shape of the cam surface 632 at the inner peripheral surface of the annular member 63 will be described.

Further, as shown in FIG. 7, L1>L2, where L1 is the length of a section (called "section L1") from the center of a screw stoppage portion (such as the screw stoppage portion 633*f*) to the following contact position (such as the contact position 632*a*) in the direction of movement of the cam receiving roller 93 relative to the annular member 63, and L2 is the length of a section (called "section L2") from this contact position (such as the contact position 632*a*) to the following screw stoppage portion (such as the screw stoppage portion 633*a*). When L1>L2, the curvature of the section L1 of the cam surface 632 is made small.

The shape of the cam surface 632 is such that the same curvature is repeated each time the cam surface 632 is rotated by 60 degrees for one circumference of the cam surface 632.

The cam surface 632 protrudes at the contact positions 632*a* to 632*f* and the screw stoppage portions 633*a* to 633*f*, and is recessed therebetween. The screw stoppage portions 633*a* to 633*f* protrude to provide sufficient width for screwing to the bodies of the developing devices. The contact positions 632*a* to 632*f* protrude due to the following reason. That is, when the cam receiving roller 93 moves relative to the cam surface 632 and approaches a contact position, the engagement of the gear 94 and the gear of the developing unit (such as the gear 612_1 of the developing unit 61_1) is started before the cam receiving roller 93 reaches the contact position (the driving position where the gear of the developing unit (such as the gear 612_1 of the developing unit 61_1) has the driving force transmitted thereto from the gear 94), so that the driving of the developing unit is started early, thereby increasing image formation productivity. If the cam surface 632 is a simple arcuate surface without recesses in front of and behind the contact positions, when the cam receiving roller 93 reaches a contact position, the gear 94 and the gear of the developing unit engage, as a result of which the driving of the developing unit is started after the engagement is completed. The starting of the driving of the developing unit is delayed in correspondence with the delay of the engagement. This may reduce the image formation productivity.

Figure 9:
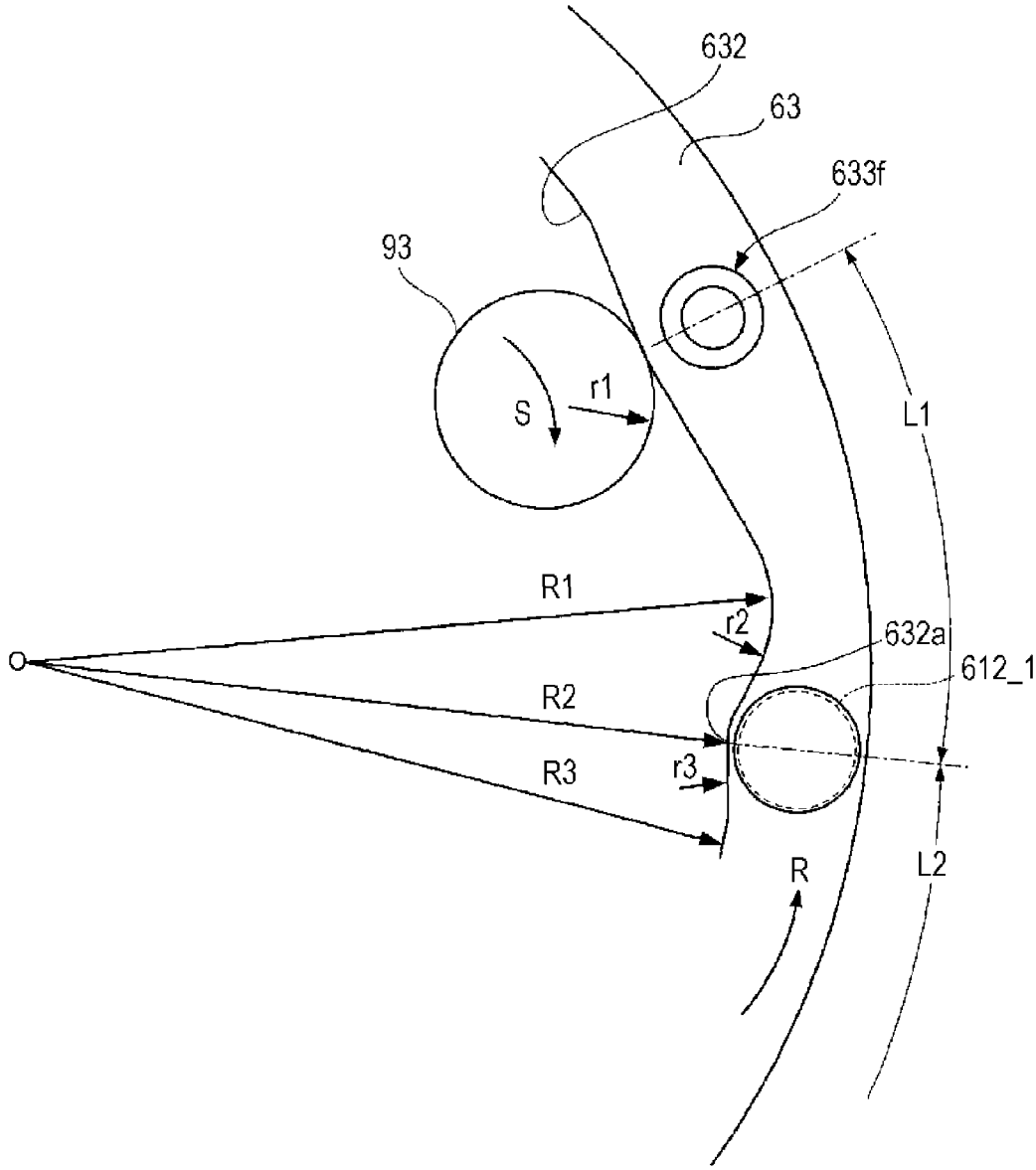
FIG. 9 shows the relationship between the dimensions of a cam receiving roller and the dimensions of a cam surface.

FIG. 9 shows the relationship between the dimensions of the cam receiving roller and the dimensions of the cam surface.

The annular member 63 that is screwed and secured to the body of the developing device rotates along with the body of the developing device in the direction of arrow R around a rotational center O. The cam receiving roller 93 moves relatively in the direction of arrow S as it rotates with respect to the annular member 63.

Here, the length from the rotational center O to the most recessed point of the cam surface 632 in the section between the screw stoppage portion 633*f* and the contact position 632*a* (that is, the section L1) is R1; the length from the rotational center O to the contact position 632*a* is R2; and the length from the rotational center O to the most recessed point of the cam surface 632*a* in the section between the contact position 632*a* and the next screw stoppage portion 633*a* (see, for example, FIG. 7) (that is, the section L2) is R3. The rotational radius of the cam receiving roller 93 is r1; the minimum radius of the section L1 of the cam surface 632 is r2; and the minimum radius of the section L2 is r3.

At this time, the cam surface 632 is such that R2<R1. That is, in the section L1, as the rotation of the annular member 63 causes the gear of the developing unit (such as the gear 612_1 of the developing unit 61_1) to move closer to the driving position where it receives the driving force from the gear 94 of the driving force transmission mechanism 90 (that is, causes the cam receiving roller 93 to move closer to the contact position (such as the contact position 632*a*), the cam receiving roller 93 moves in the direction in which it moves away from the rotational center O once, and, then, moves in the direction in which it approaches the rotational center O. R2<R1, so that, as mentioned above, a recess is formed at this location to cause the gears to quicken the engagement of the gears. In addition, r1<r2, that is, the curvature of the section L1 of the cam surface 632 is less than the curvature of the cam receiving roller 93, so that, when the cam receiving roller 92 is smoothly moved relative to the cam surface 632 along the cam surface 632, generation of noise is suppressed.

By making the length of the section L1 longer than the length of the section L2 (see FIG. 7), the curvature of the cam surface 632 at the section L1 is made sufficiently small.

Figure 10:
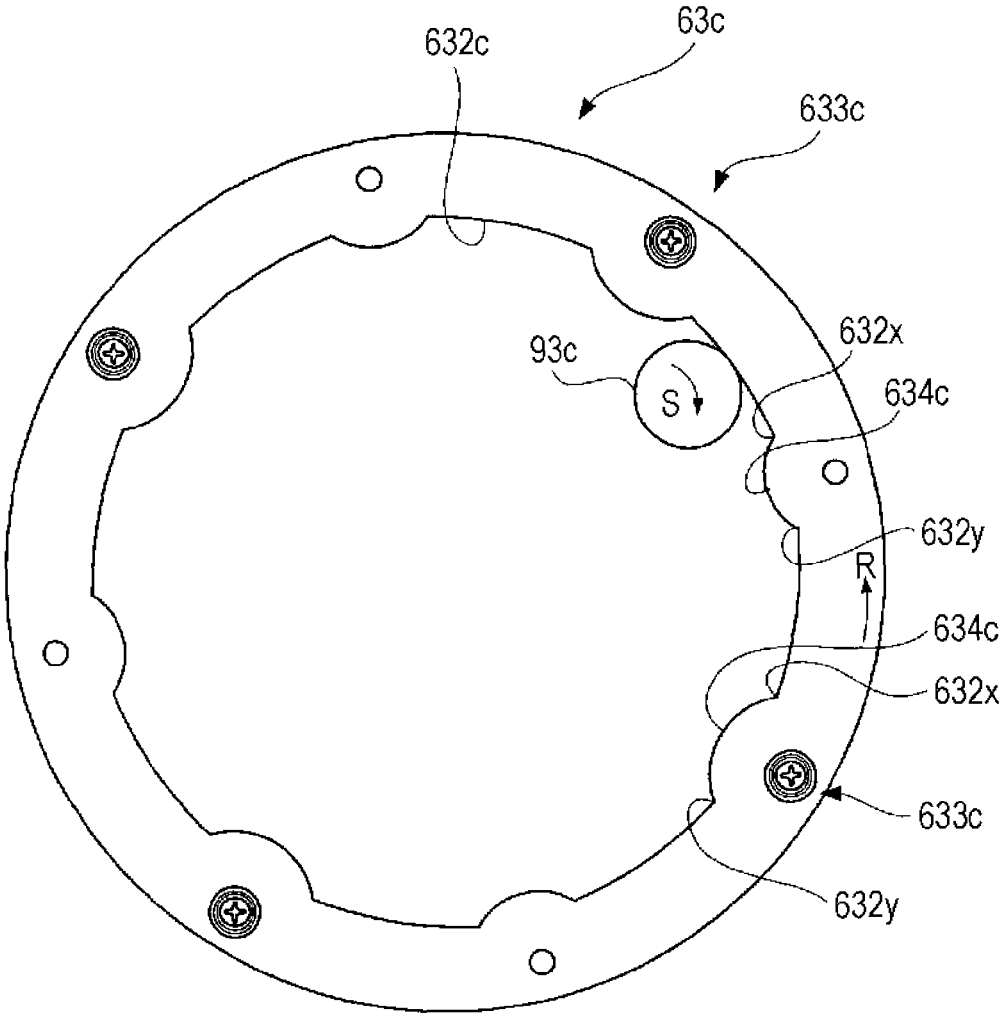
FIG. 10 shows an annular member and a cam receiving roller in a comparative example.

FIG. 10 shows an annular member 63*c* and a cam receiving roller 93*c* in a comparative example.

The annular member 63*c* is provided at a rotary developing device including four developing units. A cam surface 632*c* is used as an inner peripheral surface of the annular member 63*c*. The cam receiving roller 93*c* is pushed against the cam surface 632*c*.

Screw stoppage portions 633*c* and contact positions 634*c* of the cam surface 632*c* of the annular member 63*c* protrude in an arcuate form. Angles at which a curved surface and a curved surface discontinuously contact each other are formed at a starting point 632*x* (where the protruding of the arcuate form starts) and an ending point 632*y* (where the protruding of the arcuate form ends). The screw stoppage portions 633*c* protrude to provide space for screwing. The contact positions 634*c* protrude to cause the gears to quicken the engagement of gears.

Here, as rotation of the annular member 63*c* in the direction of arrow R causes the cam receiving roller 93*c* to move relatively in the direction of arrow S, the cam receiving roller 93*c* directly collides with a protruding portion without contact the protruding starting point 632*x*, during which an unpleasant noise is generated. When the cam receiving roller 93*c* moves away from the protruding portion, the cam receiving roller 93*c* suddenly separates from the protruding portion without contacting the protruding ending point 632*y*, during which an unpleasant noise is also generated.

The description will be continued with reference to FIG. 9.

In the case of the cam surface 632 shown in FIG. 9, since r1<r2, the cam receiving roller 93 moves smoothly along the cam surface 632 while contacting the cam surface 632, thereby suppressing the generation of noise.

In the example shown in FIG. 9, R2<R3 (<R1). That is, when the annular member 63 rotates, the cam surface 632 allows the cam receiving roller 93 to move away from the rotational center O in a radial direction when the gear of the developing unit (such as the gear 612_1 of the developing unit 61_1) moves away from the driving position where it receives the driving force from the gear 94 of the driving force transmission mechanism 90. In addition, r1<r3. That is, as with the section L1, the section L2 has a curved surface whose curvature is less than the curvature of the cam receiving roller. R2<R3 (<R1), and r1<r3 because, compared to when R2=R3=r3, even if the cam receiving roller 93 moves slightly past the contact position 632*a*, a variation in the engagement between the gear 94 and the gear of the developing unit is small, so that the allowance of displacement of a stopping position of the cam receiving roller 93 (that is, the stopping position of the annular member 63) is increased.

Here, although, a rotary developing device including six developing units and an image forming apparatus including the developing device are described, the present invention is not limited to developing devices including six developing units. The present invention is applicable to any developing devices as long as they include multiple developing units.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a plurality of developing units each including a first gear that receives driving force and a development roller that rotates by the driving force received by the first gear;

a rotation supporting member that is supported by a base so as to be rotatable around a rotation axis, the rotation supporting member supporting the developing units around the rotation axis, the rotation of the rotation supporting member causing the developing units to revolve around the rotation axis;

a cam member having a cam surface surrounding the rotation axis, the cam member being secured to the rotation supporting member and rotating together with the rotation supporting member; and a driving force transmission member including a cam receiving roller and a second gear, the cam receiving roller being biased towards the cam surface while being supported by the base so as to be changeable between to contact and separate from the cam surface, the biasing pushing the cam receiving roller against the cam surface, the second gear being biased along with the cam receiving roller, the second gear engaging the first gear of the developing unit among the developing units whose development roller is moved to a position opposing an image carrying member by the rotation of the rotation supporting member, and transmitting the driving force to the first gear to develop a latent image on the image carrying member, wherein the cam surface includes a curved surface whose curvature is less than a curvature of the cam receiving roller so that, as the first gear approaches a driving position where the first gear receives the driving force from the second gear by the rotation of the cam member, the cam receiving roller is moved away from the rotation axis once, after which the cam receiving roller is moved towards the rotation axis, thereby starting the engagement of the first gear with the second gear before the first gear reaches the driving position.

2. The developing device according to claim 1, wherein the cam surface has the curved surface whose curvature is less than the curvature of the cam receiving roller so that, as the first gear moves away from the driving position at the cam surface by the rotation of the cam member, the cam receiving roller is moved radially away from the rotation axis.

3. The developing device according to claim 2, wherein the cam member has a securing portion that is used to secure the cam member to the rotation supporting member and that is disposed between two contact positions where the cam receiving roller contacts the cam surface when two of the first gears of two of the developing units supported at positions adjacent to each other around the rotation axis are at the driving position, and wherein the cam member is a long member whose length from the securing portion adjacent to one of the contact positions to the next contact position is longer than a length from the one of the contact positions to the securing portion, towards a downstream side in a direction of relative movement of the cam receiving roller as the cam member rotates.

4. The developing device according to claim 1, wherein the cam member has a securing portion that is used to secure the cam member to the rotation supporting member and that is disposed between two contact positions where the cam receiving roller contacts the cam surface when two of the first gears of two of the developing units supported at positions adjacent to each other around the rotation axis are at the driving position, and wherein the cam member is a long member whose length from the securing portion adjacent to one of the contact positions to the next contact position is longer than a length from the one of the contact positions to the securing portion, towards a downstream side in a direction of relative movement of the cam receiving roller as the cam member rotates.

5. An image forming apparatus comprising:

an image carrying member where an electrostatic latent image formation operation and a developing operation are performed, to carry a developed image;

a developing device that develops an electrostatic latent image formed on the image carrying member;

a transfer unit that transfers the developed image on the image carrying member to a recording medium; and a fixing unit that fixes the developed image transferred to the recording medium to the recording medium, wherein the developing device includes a plurality of developing units each including a first gear that receives driving force and a development roller that rotates by the driving force received by the first gear;

a rotation supporting member that is supported by a base so as to be rotatable around a rotation axis, the rotation supporting member supporting the developing units around the rotation axis, the rotation of the rotation supporting member causing the developing units to revolve around the rotation axis;

a cam member having a cam surface surrounding the rotation axis, the cam member being secured to the rotation supporting member and rotating together with the rotation supporting member; and a driving force transmission member including a cam receiving roller and a second gear, the cam receiving roller being biased towards the cam surface while being supported by the base so as to be changeable between contacting and separating from the cam surface, the biasing pushing the cam receiving roller against the cam surface, the second gear being biased along with the cam receiving roller, the second gear engaging the first gear of the developing unit among the developing units whose development roller is moved to a position opposing the image carrying member by the rotation of the rotation supporting member, and transmitting the driving force to the first gear to develop a latent image on the image carrying member, wherein the cam surface includes a curved surface whose curvature is less than a curvature of the cam receiving roller so that, as the first gear approaches a driving position where the first gear receives the driving force from the second gear by the rotation of the cam member, the cam receiving roller is moved away from the rotation axis once, after which the cam receiving roller is moved towards the rotation axis, thereby starting the engagement of the first gear with the second gear before the first gear reaches the driving position.

6. The image forming apparatus according to claim 5, wherein the cam surface has the curved surface whose curvature is less than the curvature of the cam receiving roller so that, as the first gear moves away from the driving position at the cam surface by the rotation of the cam member, the cam receiving roller is moved radially away from the rotation axis.

7. The image forming apparatus according to claim 6, wherein the cam member has a securing portion that is used to secure the cam member to the rotation supporting member and that is disposed between two contact positions where the cam receiving roller contacts the cam surface when two of the first gears of two of the developing units supported at positions adjacent to each other around the rotation axis are at the driving position, and wherein the cam member is a long member whose length from the securing portion adjacent to one of the contact positions to the next contact position is longer than a length from the one of the contact positions to the securing portion, towards a downstream side in a direction of relative movement of the cam receiving roller as the cam member rotates.

8. The image forming apparatus according to claim 5, wherein the cam member has a securing portion that is used to secure the cam member to the rotation supporting member and that is disposed between two contact positions where the cam receiving roller contacts the cam surface when two of the first gears of two of the developing units supported at positions adjacent to each other around the rotation axis are at the driving position, and wherein the cam member is a long member whose length from the securing portion adjacent to one of the contact positions to the next contact position is longer than a length from the one of the contact positions to the securing portion, towards a downstream side in a direction of relative movement of the cam receiving roller as the cam member rotates.

* * * * *